US005848502A

United States Patent [19]

Schaefer

[11] Patent Number: 5,848,502

[45] Date of Patent: Dec. 15, 1998

[54] REMOVABLE POST SUPPORT SYSTEM

[75] Inventor: Richard Floyd Schaefer, Ft. Lupton, Colo.

[73] Assignee: S-Square Tube Products, Commerce City, Colo.

[21] Appl. No.: 961,878

[22] Filed: Oct. 31, 1997

[51] Int. Cl.[6] ..... E02D 5/74; E02D 27/42

[52] U.S. Cl. ..... 52/165; 52/169.13; 52/170; 52/298; 248/156; 248/519; 248/530; 40/606

[58] Field of Search ..... 52/40, 165, 169.13, 52/170, 296, 297, 298; 248/156, 519, 530, 545; 40/606

[56] References Cited

U.S. PATENT DOCUMENTS 626,607 6/1899 Genter ..... 52/298
2,605,074 7/1952 Bucsko et al. .
4,021,977 5/1977 Deike .
4,320,608 3/1982 Deike ..... 52/165
4,553,358 11/1985 Deike ..... 248/519 X
5,395,081 3/1995 Vollink .
5,404,682 4/1995 West .
5,438,782 8/1995 Belobraydich et al. .

*Primary Examiner*—Robert Canfield
*Attorney, Agent, or Firm*—Patent Law Offices of Rick Martin, P.C.

[57] ABSTRACT

A system for mounting road signs and other posts which is simple to use, has few parts and is tamper resistant. The system also allows for the easy dismounting of the post for maintenance and changing of signs. The system uses a metal base driven into the ground, a non-square post with at least one flat side and a bifurcated wedge to lock the post into position in the base. This system also prevents rotation of the post due to winds or other forces.

11 Claims, 3 Drawing Sheets

REMOVABLE POST SUPPORT SYSTEM

CROSS REFERENCE PATENTS

This application is co-pending with design patent application Ser. No. 29/077,426.

FIELD OF INVENTION

The present invention relates to support and mounting system for posts, particularly, sign posts.

BACKGROUND OF THE INVENTION

Sign posts for highway and road signs pose a number of design problems. They have to withstand a large variety of weather conditions, including high winds and extremes of temperature. They must be securely mounted in the ground to provide long life and to prevent theft and tampering. However, the signs on the posts often have to be changed or replaced.

It is also not uncommon for the post to be damaged by cars and then have to be replaced. On being struck, a car will break off the post, generally close to the ground. This requires that the post be replaced.

There are a variety of different types of sign posts and mounting systems that are currently used. The posts are made from wood, plastic and metal, and are generally either square or round. The type of material used depends on the desired characteristic of the sign and post.

Wood is often seen as the most aesthetically pleasing, but does not last as long as metal or some plastics. Wood weathers much faster than metal and most plastics. Additionally, it is not possible to use wood with tall highway signs, as it is not strong enough to withstand the bending force caused by winds. The wood posts must also be larger in diameter than a comparable metal or plastic post to have the same structural integrity.

Wood posts are most often installed by being driven directly into the ground or cemented into a hole in the ground. This means that no additional hardware is needed, but makes replacing the signs difficult. This is due to having to dig the base of the post out of the ground before installing the new post. This procedure becomes more difficult if a car has broken the post off close to the ground. Wood is also more easily split by a glancing hit from a car, causing it to have to be replaced more frequently.

The sign is mounted to a wooden sign post by bolting the sign directly to the post. A hole must be drilled through the wood post before mounting the sign. As a result, the sign can be relatively easily removed by vandals by unscrewing the bolt.

Plastic sign posts have gained in popularity in many areas, particularly were the sign is likely to sustain a large number of glancing blows. One example of this is in regions with heavy snow fall, requiring the streets to be plowed regularly. It is very common for snow plow crews to run into sign posts. Sometimes the post is buried in the snow so it cannot be seen. Other times the driver simply mis-judges the distance to the post and clips the post with the edge of the snow plow blade.

The road maintenance authority does not want to have to replace either the blade of the plow or the sign posts very often. This makes flexible plastics ideal for this type of use, particularly for the short reflector posts on curves, etc. These posts are very commonly hit by cars or snow plows.

Plastic posts are almost always circular cross section, which is the easiest shape to manufacture plastic posts in.

The sign is either bolted to the plastic post, often deforming the cross section, or the sign is mounted using clamping brackets, again deforming the plastic.

However, the flexible plastics will not work for heavy signs or if a large amount of bending force is going to be placed on the post by wind, etc. The more rigid plastic may work for smaller signs, but still would not work for the large signs. Also, plastics often have similar weathering problems to wood, requiring that the plastic posts be replaced more often, even if they are not damaged by impact.

To mount the plastic posts in the ground they are either driven directly into the ground or a metal base is driven into the ground. FIG. 2 shows a prior art mounting system 6 in cross section. The plastic post 8 is slid into a base 9. The ridged wedge 7 digs into the plastic base 9 or into the post 8 with an interference fit to create friction to hold the post 8 in place. The friction of the wedge 7 is supposed to prevent rotation of the post. However, it is very easy for water or oil to get down in the system and dramatically reduce the amount of friction. This is particularly true during storms, which often have high winds to rotate the sign. Additionally, a strong torque could be greater than the amount of frictional force, resulting in the sign becoming unaligned with the road.

U.S. Pat. No. 4,021,977 (1977) to Deike discloses a system of removably mounting a plastic sign post using a wedge system. However, the wedge deforms the plastic post to prevent rotation, so the system cannot be used with metal or wood posts.

The third approach for building traffic sign posts is the use of metal sign posts. Metal sign posts have the advantage of long life and strength. They are the only option for tall highway signs. Metal posts are most often either square or round. The most common type of square post has holes drilled through all four sides at regular intervals to allow signs to be bolted to the post. With round posts either a bracket is used or holes are drilled to allow the sign to be bolted to the post.

Metal posts are mounted into the ground by either driving the post directly into the ground or mounting the post into a base that is driven into the ground. See base 10 in FIG. 3. Generally, a square base is used with holes driven through all four sides of the base at equal intervals. The square post is then slid inside the base and the holes in the base are aligned with the holes in the post and a bolt is placed through the base and the post to secure the post.

Another type of mounting for metal posts is shown in FIG. 1. The mounting system 1 consists of a flanged base 4, a triangular wedge 3 and a post 2. Post 2 can be either round as shown or square. The triangular wedge 3 is slid into space 5 to wedge the post 2 up against the base 4. This system only works well with square or round posts. Other shapes do not work due to the shape of the wedge. Although the flanged base 4 is resistant to rotation, it is also quite large and cannot be used in small spaces. It can only be used with bare ground, not asphalt or concrete, as it would split the concrete or asphalt. Additionally, the wedge 3 and the flanged base 4 both require large amounts of materials and labor. The parts of the flanged base 4 are welded together, as is the edge of the wedge 3.

U.S. Pat. No. 5,404,682 (1995) to West also discloses an adjustable mount system to mount a sign post in the ground. However, the system is primarily designed to allow the post to automatically remain at vertical. The system has large amounts of hardware and is very complex.

There is a need for a simple, easy to use, secure mounting system to use with a wide range of shapes of metal posts.

The system must be reusable, allow for the easy changing of signs, prevent rotation of the post, and allow for easy mount of both sign and post. The present invention has three pieces, a base, a post and a bifurcated wedge, all made of metal. The post can have a variety of shapes which fit inside the base. The bifurcated wedge fits on either side of a ridge in the post thus preventing rotation of the post.

SUMMARY OF THE INVENTION

The primary aspect of the present invention is to provide a simple, easy to manufacture and use system to securely mount highway signs.

A second aspect of the present invention is to prevent rotation of the post. The shape of the post allows the bifurcated wedge to be driven in between the inside surface of the base and the outer surface of the post. The two legs of the wedge must be on either side of a ridge of the post to prevent rotation of the post. As the base is generally square this means that the post cannot be square. The post must also have at least one flat side to allow the sign to be securely mounted inside the base.

Another aspect of the present invention is to provide a mounting system that is reusable to allow for easy changing of signs and the replacement of broken posts.

Another aspect of the present invention is to provide a system that is relatively tamper resistant to prevent theft of or tampering with the road signs.

Other objects of this invention will appear from the following description and appended claims, reference being made to the accompanying drawings forming a part of this specification wherein like reference characters designate corresponding parts in the several views.

The post is slid into the base. The sign can be mounted either before or after the post is placed in to the base. The bifurcated wedge is then placed inside the base between the inside of the base and the post. The two legs of the bifurcated wedge are positioned on either side of a ridge in the post. The bifurcated wedge is then driven down into the base to lock the post in place.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DESCRIPTION OF THE PREFERRED EMBODIMENT

Figure 3:
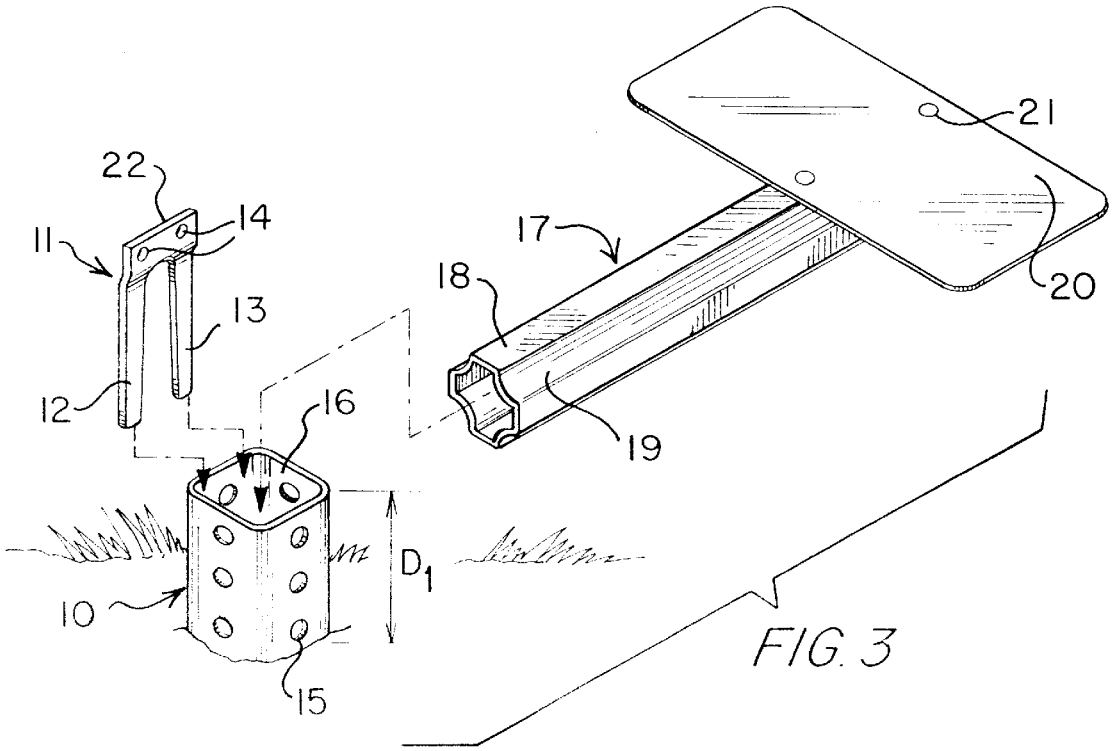
FIG. 3 is an exploded view of the preferred embodiment.

FIG. 3 is a exploded view of the preferred embodiment. The base 10 is driven into the ground using a driving tool or sledge hammer. The base can be flush with the ground or is left sticking up above the ground a given distance, $D_1$. FHWA regulations require that $D_1$ be 3 inches or less. The base can either have solid sides (not shown) or have holes 15.

The post 17 must have at least one ridge 18 and at least two receiving hollows 19 to allow the bifurcated wedge 11 to work. The shape of the post in the preferred embodiment is a modified octagon. Alternating sides of the octagon have an inward curve. This shape is preferred for ascetic reasons, not functional.

Figure 6:
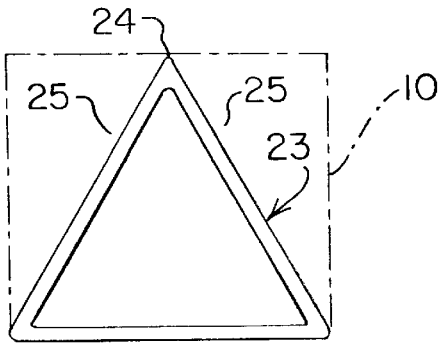
FIG. 6 is a cross sectional view of a triangular post shape.
Figure 7:
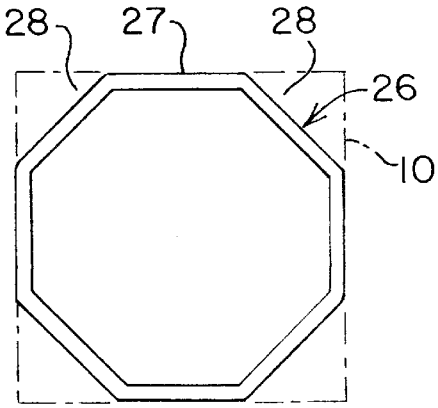
FIG. 7 is a cross sectional view of an octagonal post shape.
Figure 8:
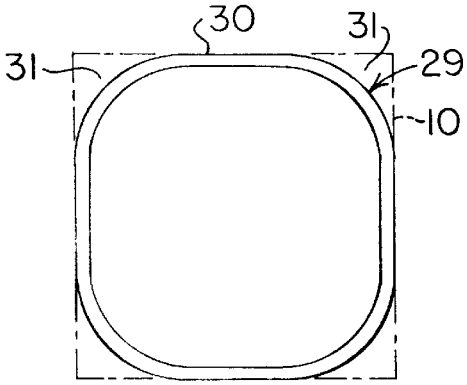
FIG. 8 is a cross sectional view of a rounded square post shape.
Figure 10:
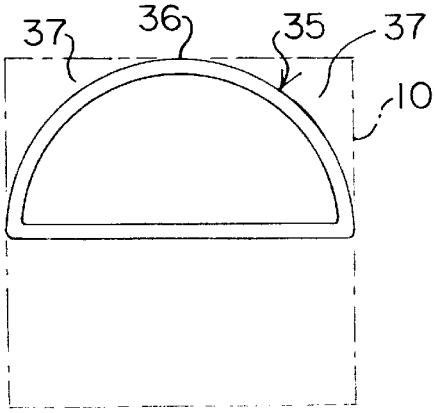
FIG. 10 is a cross sectional view of a half circular post shape.
Figure 9:
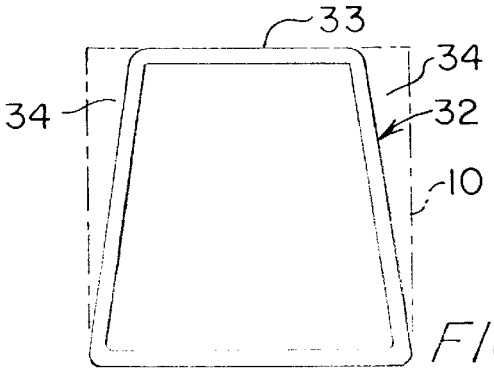
FIG. 9 is a cross sectional view of a pentagonal post shape.
Figure 11:
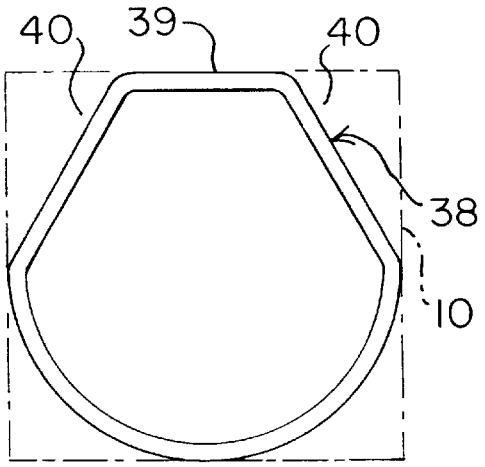
FIG. 11 is a cross sectional view of a trapezoidal shape with a curved base as a post.
Figure 12:
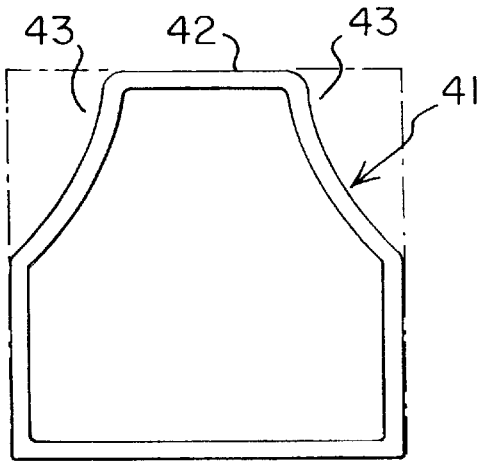
FIG. 12 is a cross sectional view of a modified hexagon with two curved sides as a post shape.
Figure 13:
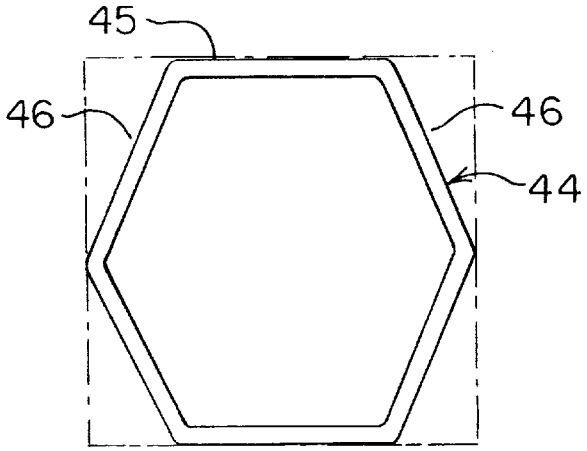
FIG. 13 is a cross sectional view of a hexagonal post shape.

The post can have a wide range of shapes and allow the bifurcated wedge 11 to work. Some of the possible shapes are shown in FIGS. 6–13. FIG. 6 is a cross sectional view of a triangular post 23 with ridge 24 and receiving hollows 25. A standard octagonal post 26 with ridge 27 and receiving hollows 28 is shown in FIG. 7. FIG. 8 is a rounded squared post 29 with ridge 30 and receiving hollows 31. FIG. 9 is a modified trapezoidal post 32 with ridge 33 and receiving hollows 34. FIG. 10 is a half circle post 35 with ridge 36 and receiving hollows 37. Post 38 has the shape of trapezoid with a round base with ridge 39 and receiving hollows 40 as shown in FIG. 11. FIG. 12 has a post 41 a modified hexagon with two curved sides which are the receiving hollows 43 on either side of ridge 42. FIG. 13 has post 44 which has a elongated hexagon shape with ridge 45 and receiving hollows 46.

Some of these shapes, such as in FIG. 10, would also require spacers (not shown) in addition to the bifurcated wedge.

The sign 20 is fastened to the post 17 before the post is mounted in the base. This allows for easier mounting of signs and faster installation and changing of signs.

The bifurcated wedge 11 has two legs 12 and 13 extending from a tab 22. The tab 22 has holes 14. The holes 14 allow a wedge puller or slide hammer, not shown, to be attached to remove the wedge 11. The bifurcated wedge 11 is placed on the hollow inside 16 of the base with legs 12, 13 on either side of the ridge 18 inside the receiving hollow 19.

Figure 1:
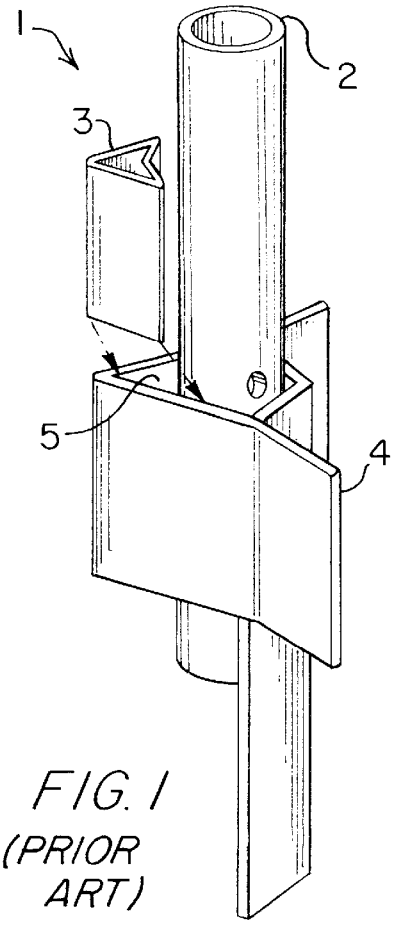
FIG. 1 (PRIOR ART)
FIG. 1 is a perspective view of one of the prior art sign post base systems.
Figure 2:
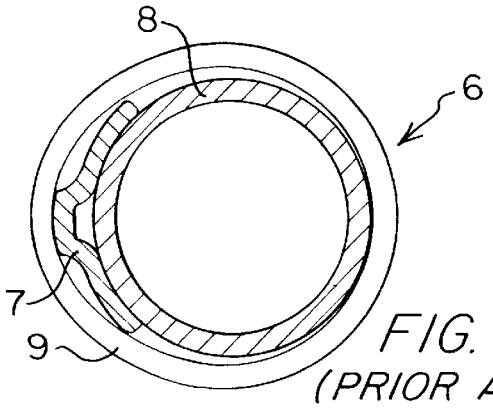
FIG. 2 (PRIOR ART)
FIG. 2 is a perspective view of another prior art sign post base system having a wedge.
Figure 5:
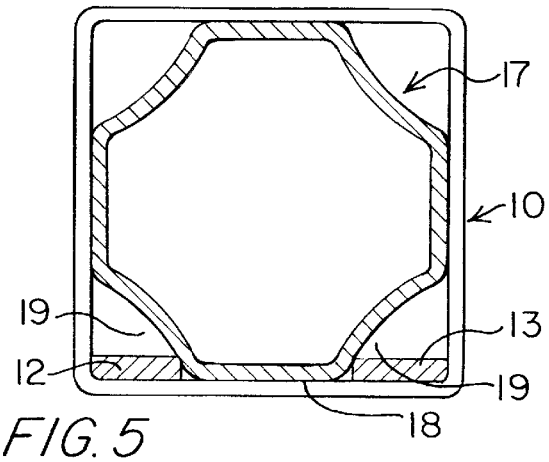
FIG. 5 is a cross sectional of the base taken along line 5—5 of FIG. 4.

As shown in FIG. 5 the legs 12 and 13 frictionally lock the post 17 in place by fitting on either side of the ridge 18. The legs 12 and 13 must taper up towards the top 22 and have sufficient width near the tab 22 to lock the post 17 in place, this is called the locking width. The different shapes of posts 17 shown in FIGS. 6–13 would in many cases require a different leg width than the bifurcated wedge of the preferred embodiment.

Figure 4:
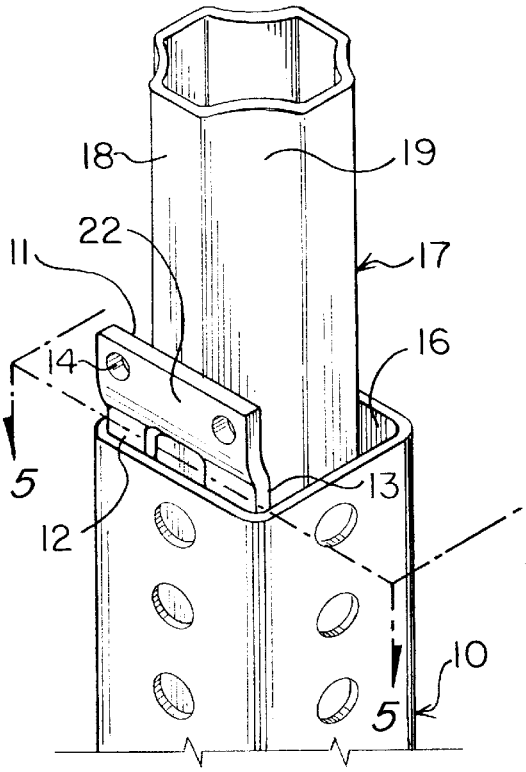
FIG. 4 is a front perspective view of the preferred embodiment with the bifurcated wedge driven into position.

FIG. 4 shows the preferred embodiment with the bifurcated wedge 11 driven down into the base. The locking width of the legs 12 and 13 is preferably near the top 22 to further reduce the possibility of unauthorized removal of the post 17. The small size of the bifurcated wedge 11 and its closeness to the ground, $D_1$ makes the bifurcated wedge very difficult to remove without the appropriate tool of a wedge puller or slide hammer, which are not common household tools.

Figure 14:
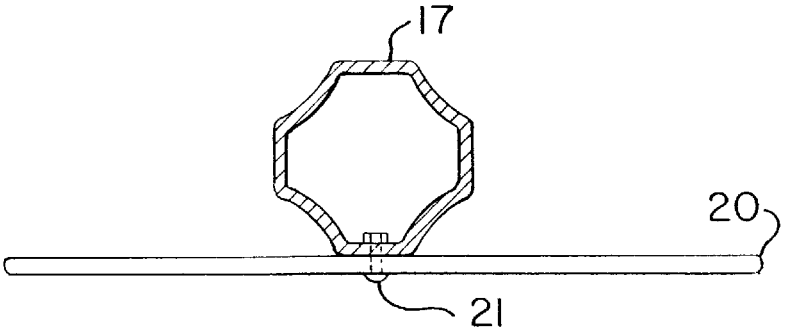
FIG. 14 is a cross sectional view of the preferred embodiment with a sign bolted to the post.

The sign 20 can be fastened to the post 17 by drilling holes through the metal post 17 and bolting the sign 20 directly to the post 17 with bolt 21, as shown in FIG. 14. The post must have at least one flat surface to fit against one of the inside surfaces of the base and to mount the sign to, in order to prevent the sign from rocking.

Although the present invention has been described with reference to preferred embodiments, numerous modifications and variations can be made and still the result will come within the scope of the invention. No limitation with respect to the specific embodiments disclosed herein is intended or should be inferred.

KEY

| | |
|---|---|
| 1. Prior art mounting system | 23. triangular post |
| 2. Post | 24. ridge |
| 3. triangular wedge | 25. receiving hollows |
| 4. base | 26. octagonal post |
| 5. space | 27. ridge |
| 6. Prior art mounting system | 28. receiving hollows |
| 7. ridged wedge | 29. rounded square post |
| 8. plastic post | 30. ridge |
| 9. plastic base | 31. receiving hollows |
| 10. base | 32. trapezoidal post |
| 11. bifurcated wedge | 33. ridge |
| 12. leg | 34. receiving hollows |
| 13. leg | 35. half circular post |
| 14. holes | 36. ridge |
| 15. holes | 37. receiving hollows |
| 16. inside of base | 38. curved base trapezoidal post |
| 17. post | 39. ridge |
| 18. ridge | 40. receiving hollows |
| 19. receiving hollows | 41. modified hexagonal post |
| 20. sign | 42. ridge |
| 21. bolt | 43. receiving hollows |
| 22. tab | 44. hexagonal post |
| | 45. ridge |
| | 46. receiving hollows |

I claim:

1. A sign post mounting system comprising;

a square base suitable for mounting into a support surface;

said square base having a central hollow for receiving a sign post;

a sign post;

said sign post having a flat outside edge to engage a flat inside edge of the central hollow;

said sign post having a ridge which creates two receiving hollows; a bifurcated wedge having a pair of legs joined by a tab, wherein said tab is adapted to be forced downward to lock the pair of legs into the two receiving hollows, thereby locking the sign post into the square base.

2. The sign post mounting system of claim 1, wherein all parts are metal.

3. The sign post mounting system of claim 1, wherein the post has an octagonal shape with alternating sides having an inward curve.

4. The sign post mounting system of claim 1, wherein the post has a triangular shape.

5. The sign post mounting system of claim 1, wherein the post has a octagonal shape.

6. The sign post mounting system of claim 1, wherein the post has a rounded square shape.

7. The sign post mounting system of claim 1, wherein the post has a trapezoidal shape.

8. The sign post mounting system of claim 1, wherein the post has a half circular shape.

9. The sign post mounting system of claim 1, wherein the post has a trapezoidal shape with a curved base.

10. The sign post mounting system of claim 1, wherein the post has a modified hexagon with two of the sides having an inward curve.

11. The sign post mounting system of claim 1, wherein the post has a hexagonal shape.

* * * * *